United States Patent [19]

Uttscheid

[11] Patent Number: 4,644,873

[45] **Date of Patent: * Feb. 24, 1987**

[54] ELECTRIC OVERHEAD TROLLEY CONVEYOR

[76] Inventor: Georg Uttscheid, Rosenheimer Str. 117, D-2808 Kolbermoor, Fed. Rep. of Germany

[ * ] Notice: The portion of the term of this patent subsequent to Aug. 7, 2001 has been disclaimed.

[21] Appl. No.: 696,180

[22] Filed: Jan. 29, 1985

[30] Foreign Application Priority Data

Feb. 1, 1984 [DE] Fed. Rep. of Germany ..... 3403460

[51] Int. Cl.[4] ..... B61C 11/04; E01B 25/04; E01B 25/22

[52] U.S. Cl. ..... 105/29.1; 104/93; 105/127; 105/153; 74/422

[58] Field of Search ..... 74/422, 209, 212, 432; 105/29 R, 96, 127, 153; 104/89, 93, 110

[56] References Cited

U.S. PATENT DOCUMENTS 3,337,985 8/1967 Ryan et al. ..... 105/29 R X
4,067,260 1/1978 Finsterwald ..... 105/29 R
4,287,831 9/1981 Farkas ..... 105/29 R
4,463,683 8/1984 Uttscheid ..... 105/29 R

FOREIGN PATENT DOCUMENTS 528053 6/1931 Fed. Rep. of Germany .... 105/29 R

*Primary Examiner*—Robert B. Reeves
*Assistant Examiner*—David F. Hubbuch
*Attorney, Agent, or Firm*—Cahill, Sutton & Thomas

[57] ABSTRACT

An electric overhead trolley conveyor is described whereby electric trolleys can drive automatically with reduced velocity in inclining, declining or vertical sections or in selected horizontal sections of the rail without a special control of the electric motor or the drive. For this purpose, chains or racks are provided in sections for reduced speed which mesh with sprocket wheels or gears of the electric trolleys. In the other areas of the rail the electric trolleys are driven by a drive wheel. The circumferential velocity of the drive wheel is greater than the circumferential velocity of the sprocket wheel or gear. In the slow movement sections the circumferential velocity difference is compensated by the drive wheel which has an outer ring, that may rotate relative to an inner hub which is fixedly connected with the drive shaft.

7 Claims, 8 Drawing Figures

ELECTRIC OVERHEAD TROLLEY CONVEYOR

This invention relates to an electric overhead trolley conveyor with a rail having horizontal sections as well as inclining and declining and/or vertical sections for electric trolleys and having at least one drive wheel engaging the rail. The drive wheel has an inner hub connected with a drive shaft as well as an outer ring rotatably held by the hub and with chains or racks in the inclining, declining and/or vertical sections of the rail with which at least one drive sprocket wheel or gear meshes.

Such an electric overhead trolley conveyor is known from U.S. Pat. No. 4,463,683. Reference is made to this patent application for the purposes of disclosure.

With such electric overhead trolley conveyors a problem arises in that during normal horizontal operation high velocities, for example 50 m/min, are used while in vertical sections or in inclining or declining sections the electric trolleys must move with substantially reduced velocity. For this purpose costly shift gearings are used or controllable electric motors together with the necessary control devices. Further it may be necessary to reduce the velocity in certain horizontal sections, for example when the trolley moves through a rubber gate.

Therefore it is a problem of the present invention to improve the known electric overhead trolley conveyors in such a fashion, that in the desired sections a reduced velocity is obtained automatically without a controllable gearing or a controllable electric motor.

This problem is solved by an electric overhead trolley conveyor of the before mentioned type, which is characterized in that the circumferential velocity of the drive sprocket wheels or gears is smaller than the circumferential velocity of the drive wheels.

In a normal horizontal movement the electric trolleys are driven by the drive wheels. The driving force is transferred from the drive shaft to the hub of the drive wheel and from there by friction to the outer ring. The hub and the outer ring of the drive wheel rotate jointly i.e. with substantially the same angular velocity. In this case the sprocket wheel or gear does not have a function.

In vertical sections of the rail and in inclining and declining sections of the rail or in horizontal sections for slow movement a chain or a rack is provided additionally to the rail to mesh with the sprocket wheel or gear. Now, the circumferential velocity of the sprocket wheel or gear is substantially smaller than the circumferential velocity of the drive wheel. This means, that the speed of the trolley is determined by the circumferential velocity of the sprocket wheel or gear. The difference between both circumferential velocities is compensated by a rotation of the outer ring of the drive wheel relative to the hub of the drive wheel. The transition from a fast movement to a slow movement and vice versa occurs smoothly.

In case of a normal horizontal movement the electric trolley rests on the rail with its own weight and the weight of the load. In vertical sections as well as in inclining or declining sections the engagement of the sprocket wheels or gears with the chain or rack is ensured by counter pressure rolls which engage the rail on the side facing away from the drive wheel. In the area of the transitions between straight sections with different inclination (horizontal, vertical, inclined or declined sections) rail bends are used. The distance between the two running surfaces of the rail associated with the drive wheel and the counter pressure roll, respectively, is smaller in the area of the rail bends than in the straight rail sections when the drive wheel is located on the side of the rail facing away from the center of curvature. The distance between the two running surfaces is greater when the drive wheel is located on the side of the rail facing toward the center of curvature.

The invention may now be described by reference to the accompanying drawings, in which.

Figure 1:
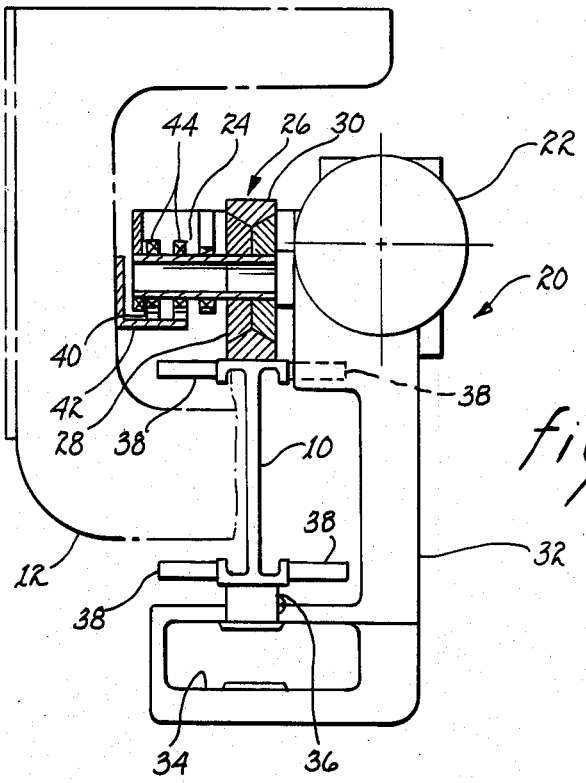
FIG. 1 shows a partly sectional schematic representation of a first embodiment of the electric overhead trolley conveyor of the present invention.

Now a first embodiment of the present invention shall be explained with reference to FIG. 1. FIG. 1 shows a rail 10 in cross-section, which has substantially a double-T-shape. It is suspended by means of brackets 12. A current-collecting rail (not shown) is connected with the rail. An electric trolley, generally denoted at 20 comprises an electric motor 22 with gearing and a drive shaft 24. The drive shaft 24 is connected with a drive wheel 26. The drive wheel has the well known compensation structure as shown in U.S. Pat. No. 4,463,681. It comprises a hub 28 fixedly connected with the drive shaft 24 consisting of two discs which are screwed together and which have a double-coned shaped outer periphery. Further, the drive wheel 26 includes an outer ring 30 which may rotate relative to the hub 28. The drive wheel 26 runs on the upper surface of the rail 10.

The electric trolley includes a yoke 32 which extends at the side of the rail facing away from the brackets 12 downward and underneath the rail 10. Here, the yoke is provided with an opening 34 for attaching a hanger for the load. Further, this part of the yoke carries two counter pressure rolls 36 which engage the lower surface of the rail 10. The two counter pressure rolls are arranged before and behind the vertical plain which passes through the axis of the drive shaft i.e. in front of and behind the plane of the drawing. Further a plurality of lateral support rolls 38 is provided to engage lateral surfaces of the rail 10. Preferably a total of 8 lateral support rolls 38 are provided, i.e. 4 at each side of the rail; two rollers are provided one behind the other in the upper part and two are provided one behind the other in the lower part of the yoke. For the sake of clarity the mounting of these rollers is not shown. In the inclining and declining sections as well as in the selected horizontal sections for slow movement chain sections 40 are attached to the brackets 12 by means of separate holders 42. In this embodiment two parallel chain sections are provided. Their pitch may show a relative displacement. Of course also a rack may be used. The drive shaft 24 carries two sprocket wheels 44 (or gears) which mesh with the chain sections. The drive wheel 26 and the sprocket wheels 44 are driven with the same angular velocity. The effective diameter of the sprocket wheels is smaller than the outer diameter of the drive wheel. Therefore the circumferential velocity of the sprocket wheels is reduced relative to the circumferential velocity of the drive wheel.

In a normal horizontal operation the sprocket wheels 44 are without function. In a transition between a horizontal section and an inclined or declined section or a vertical section of the rail the sprocket wheels 44 engage the chain sections. Now the electric trolley is driven exclusively by means of the sprocket wheels, whereby the speed of rotation of the electric motor 22 remains the same. However, the translational movement of the trolley is reduced. The hub of the drive wheel 26 rotates together with the drive shaft 24 and the sprocket wheels 44 with the same angular velocity. The outer ring 30 of the drive wheel 26 rotates with a reduced angular velocity so that its circumferential velocity may be equal to the circumferential velocity of the sprocket wheels 44. The engagement between the sprocket wheels 44 and the chain section 40 is ensured by means of the counter pressure rolls 36. In this fashion a slower movement of the trolley is achieved in the vertical sections as well as in the inclined and declined sections of the rail without controlling the electric motor or the gearing. In a similar fashion a slower movement can be achieved in selected horizontal sections which have such a chain section. A reduction of the speed in the horizontal movement may be desireable for various reasons, for example if the trolley passes a gate with pivotable rubber doors. Of course it is also possible to provide several graded reduced velocities. For this purpose it is merely necessary to provide several sprocket wheels with different radii which selectively engage associated chain sections.

Figure 2:
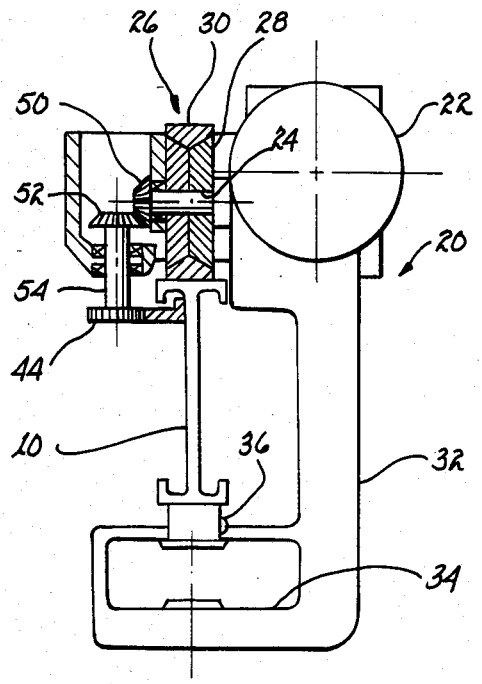
FIG. 2 shows a partly sectional partial representation of a second embodiment of the electric overhead trolley conveyor of the present invention.

In the embodiment described above the reduction of the velocity is achieved exclusively by the ratio between the radius of the sprocket wheel and the radius of the drive wheel. The extent of the reduction of speed is naturally limited in this case. FIG. 2 shows an embodiment with which a further reduction of speed is possible. In this figure some components have been removed, notably the lateral support rolls, for increasing the clarity of the representation. Only those components shall be explained which deviate from the embodiment of FIG. 1. The drive shaft 24 is connected again with the drive wheel, which is a compensation wheel. Further the drive shaft 24 carries a bevel gear 50, which meshes with a further bevel gear 52 of greater diameter. The latter is connected with a vertical shaft 54 which carries at its lower end a sprocket wheel or gear 44 which meshes with a chain section or a rack. The chain section or the rack is connected to the vertical section web of the rail of double-T-shape. If the sprocket wheel has the same effective diameter as the drive wheel the reduction of speed is produced solely by the ratio of the diameters of the two beveled gears 52 and 64. However, in the embodiment shown in FIG. 2 the effective diameter of the sprocket wheel 44 is again smaller than the outer diameter of the drive wheel 26. This leads to a multiplied reduction of the speed. Naturally several sprocket wheels or gears of different diameter may be used for realizing several degrees of speed reduction.

Figure 3:
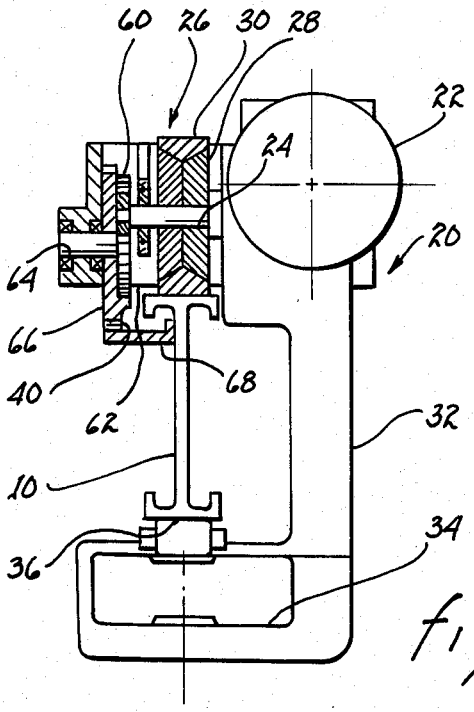
FIG. 3 shows a partly sectional schematic representation of a third embodiment of the electric overhead trolley conveyor of the present invention with some parts being removed.
Figure 4:
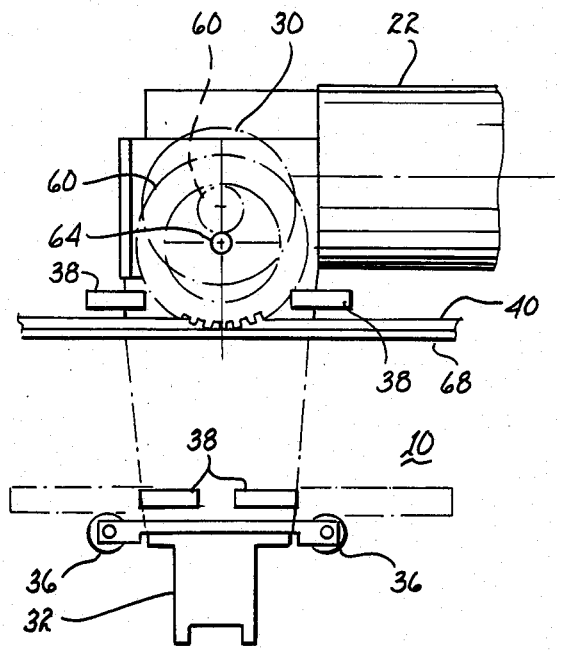
FIG. 4 shows a schematic side view of the electric overhead trolley conveyor according to FIG. 3 from the left side, whereby again some parts are removed.

FIGS. 3 and 4 show a further embodiment of the electric trolley conveyor whereby the reduction of speed is effected by means of a planetary gearing. For increasing the clarity of the representation some parts are again removed, notably in FIG. 3 the lateral support rolls. FIG. 4 shows the arrangement of the lateral support rolls 38 as well as the arrangement of the counter pressure rolls 36.

The drive shaft 24 carries again the drive wheel 26 which is a compensation wheel. At the end of the drive shaft 24 a pinion 60 is provided. It meshes with the internal teeth 62 of a gear 66 which is mounted on a shaft 64 connected to the housing of the electric trolley. The outer teeth of the gear 66 mesh with a rack or a chain. The racks or the chains are again provided in the vertical section or the inclining or declining sections as well as in selected horizontal sections of the rail. Naturally additional gears with different diameters may be provided on the shaft 64. The chain or rack is again attached to the vertical web of the rail 10, this time however with a greater spacing by means of holders 68. The function is identical with the function of the embodiment of FIG. 2. In the embodiment of FIGS. 3 and 4 the reduction of speed is effected substantially by the planetary gearing.

Figure 5:
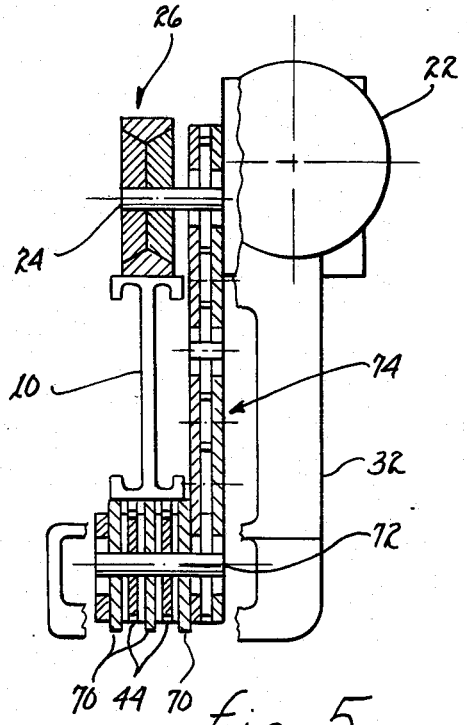
FIG. 5 shows a partly sectional schematic representation of a fourth embodiment of the electric overhead trolley conveyor of the present invention whereby some parts are removed.
Figure 6:
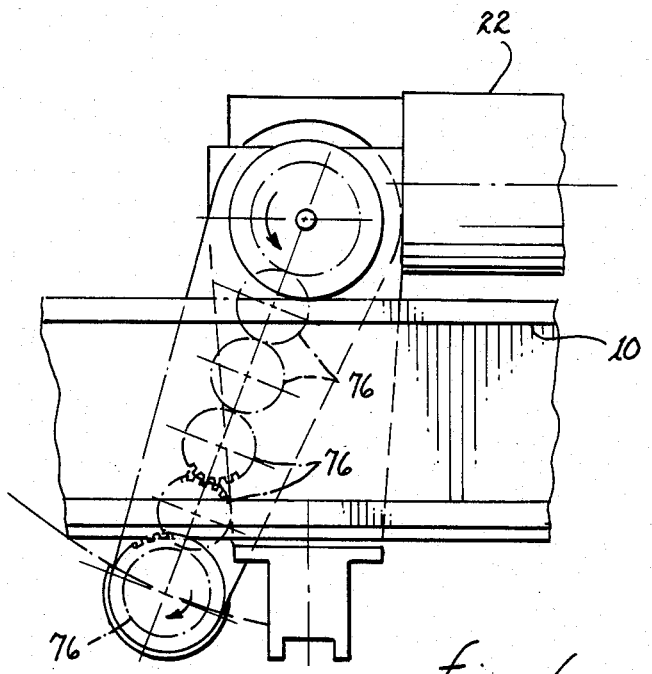
FIG. 6 shows a schematic side view of the electric overhead trolley conveyor according to FIG. 5 from the left side.

Now, a further embodiment shall be described with reference to FIGS. 5 and 6. The drive wheel 26 is again a compensation wheel and it engages the upper surface of the rail 10. The rack or chain sections for the vertical sections, the inclining or declining sections and for selected horizontal sections of the rail are provided at the lower side of the rail 10. Three support rollers 70 are provided between the sprocket wheels 44 and at both sides of the sprocket wheels 44. The two sprocket wheels 44 and the three support rolls 70 are attached to a shaft 72 which is carried by the trolley yoke 32. For increasing the clarity of the representation the attachment is now shown. According to FIG. 6 the sprocket wheels 44 are arranged in front of (seen in the driving direction) the vertical plane passing through the axis of the drive shaft 24. The driving force is transmitted from the drive shaft 24 through a train of gears 76 to the sprocket wheels 44. In the schematic representation of FIG. 6 this train of gears comprises a total of 6 gears 76. This leads to a reversal of the direction of rotation of the sprocket wheels 44 relative to the direction of rotation of the drive wheel 26. Further the ratio between diameters of the individual gears is chosen such that a speed reduction is achieved. The choice of the diameter of the sprocket wheels 44 may contribute to a further speed reduction.

Figure 7:
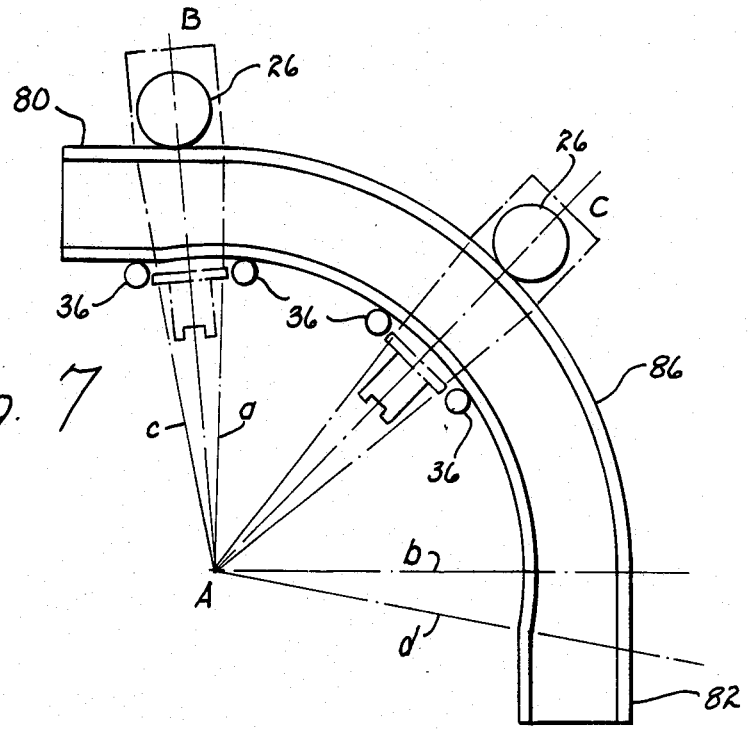
FIGS. 7 and 8 show rail bends for the transition from the straight horizontal movement to a straight vertical movement and vice versa.
Figure 8:
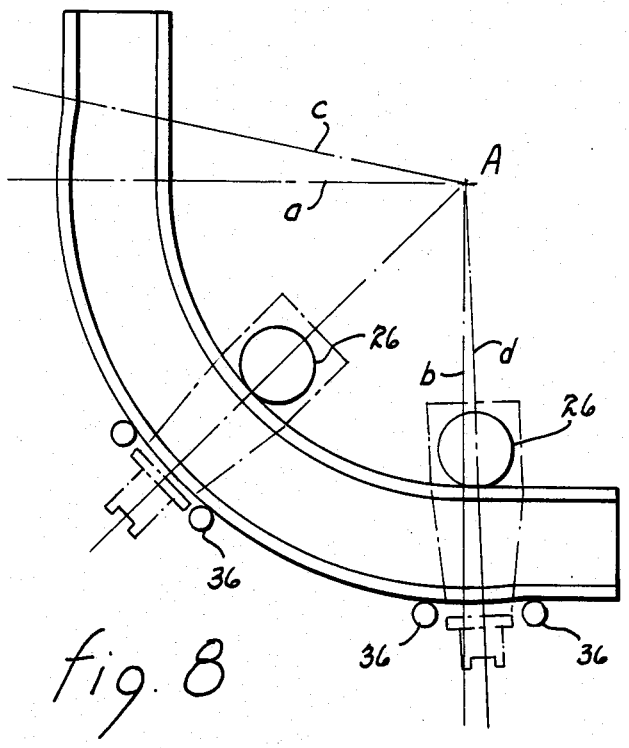

FIGS. 7 and 8 show a preferred embodiment of the rail 10 in the area of the transition between two straight sections of different inclination. FIG. 7 shows the transition from a horizontal section to a vertical section and FIG. 8 shows the transition from a vertical section to a horizontal section, whereby the electric trolley moves from the left to the right side.

A similar situation exists in a transition from (or into, respectively) inclining or declining sections. Since the two counter pressure rolls 36 are provided at both sides of the vertical plane passing through the axis of the drive wheel 26 the rail must be modified in the curved transition area for insuring a secure operation. FIG. 7 shows a horizontal rail section 80 and a vertical rail section 82. A bent rail section 86 with a center of curvature A is provided in between. The drive wheel 26 is located at the side of the rail facing away from the center of curvature A. The counter pressure rolls 36 are positioned at the side of the rail facing the center of curvature A. The broken lines a, b enclose an angle of 90°. They limit the curved outer running surface of the bent section 86 of the rail. The interior running surface of the bent section 86 extends over a greater angle which is enclosed by broken lines c, d. This is a result of the geometric situation, whereby the difference of the radii of curvature of the inner running surface and the outer running surface of the bent section of the rail is smaller than the distance between the upper running surface and the lower running surface of the straight sections 80 and 82. FIG. 4 shows, that the dimensions of the rail in the straight sections are chosen such that the drive wheel and the counter pressure rolls engage both running surfaces. FIG. 7 shows the electric trolley in a position B in a transition from the straight section of the rail to the bent section of the rail as well as the position C in the middle of the bent section. Position C shows that a simultaneous engagement of the rail by the drive wheel 26 and the counter pressure rolls 36 is ensured only if the distance between the two running surfaces is reduced in the area of the bent rail. The extent of the reduction of the distance of the two running surfaces depends upon the radius of curvature of the rail as well as on the distance between the counter pressure rolls 36. Since the ounter pressure rolls 36 are located at the inside, i.e. at the side facing the center of curvature A the distance between the two running surfaces must be reduced. FIG. 8 shows the converse case of a transition between a vertical section and a horizontal section whereby the two counter pressure rolls 36 are located at the outside, i.e. at the side of the rail facing away from the center of curvature A. In this case the distance between the two running surfaces must be increased in comparison with the distance in the straight section of the rail, but again dependent upon the radius of curvature and the distance between the two counter pressure rolls 36.

I claim:

1. An electric overhead trolley conveyor having a rail with horizontal sections and non-horizontal sections and including electric trolleys each having at least one drive wheel engaging the rail, said drive wheel having an inner hub connected to a drive shaft and having an outer ring rotatably held by said hub and contacting said rail, said non-horizontal sections each including a non-slip contact surface, each of said trolleys including a non-slip contact wheel for engaging said non-slip contact surface and driving said trolley at said non-horizontal sections, the circumferential velocity of said non-slip contact wheel being less than the circumferential velocity of the outer ring of said drive wheel.

2. The electric overhead trolley conveyor according to claim 1 wherein non-slip contact surfaces are provided in selected horizontal rail sections.

3. The electric overhead trolley conveyor of claims 1 or 2 wherein said non-slip contact wheel is secured to said drive shaft and wherein said non-slip contact wheel has a smaller diameter than said drive wheel.

4. The electric overhead trolley conveyor of claims 1 or 2 wherein said drive shaft drives said drive wheel through gear means with a reduction of speed and wherein the non-slip contact surfaces are positioned at a vertical web of the rail.

5. The electric overhead trolley conveyor of claims 1 or 2 wherein said non-slip contact surfaces are provided on opposite sides of the rail to running surfaces that are contacted by said drive wheel, and wherein said non-slip contact wheel is driven by said drive shaft through a train of gears with a reversal of the direction of rotation and with a reduction of speed.

6. The electric overhead trolley conveyor of claims 1 or 2 wherein said trolley includes two counter pressure rolls located one behind the other in the direction of travel of the trolley and which engage a side of the rail facing away from the running surface of the rail contacted by said drive wheel.

7. The electric overhead trolley conveyor of claim 6 wherein a distance from the rail surface for the drive wheel to a rail surface for the counter pressure rolls in the area of curvatures of the rail at transitions from a straight horizontal section to a non-horizontal section is smaller or larger than the straight section when the drive wheel is at the outside or at the inside, respectively, of said curvature by an amount which depends upon the distance between the counter pressure rolls and the radius of curvature of the rail at said curvature.

* * * * *